US007517327B1

(12) United States Patent
Knight

(10) Patent No.: US 7,517,327 B1
(45) Date of Patent: Apr. 14, 2009

(54) MASSAGING SYSTEM AND METHOD

(76) Inventor: Andrew F. Knight, 2521 Glengyle Dr., Vienna, VA (US) 22181

( * ) Notice: Subject to any disclaimer, the term of this patent is extended or adjusted under 35 U.S.C. 154(b) by 879 days.

(21) Appl. No.: 10/842,422

(22) Filed: May 11, 2004

(51) Int. Cl.
*A61H 1/00* (2006.01)

(52) U.S. Cl. ..... 601/46; 601/134

(58) Field of Classification Search ..... 601/46, 601/56, 84–85, 87, 89, 93, 108, 134, 136
See application file for complete search history.

(56) References Cited

U.S. PATENT DOCUMENTS 4,041,938 A 8/1977 Wintoniw
5,083,552 A * 1/1992 Lipowitz ..... 601/84
6,485,442 B2 * 11/2002 Batula ..... 601/87
6,494,851 B1 12/2002 Becher
6,607,499 B1 8/2003 Becher
6,648,840 B2 11/2003 Cutler et al.
6,685,659 B2 2/2004 Webb
2003/0212352 A1 * 11/2003 Kahn ..... 601/98

* cited by examiner

*Primary Examiner*—Michael A. Brown

(57) ABSTRACT

A massaging system includes an input device including a pressure-position profile sensor and a massaging device connected to and responsive to a signal received from the input device, the massaging device configured to massage at least a portion of a human body. A method of massaging includes providing a massaging system, sensing a pressure-position input profile of a manual input to the input device; and applying a pressure-position massage profile to the portion based at least in part on the pressure-position input profile.

17 Claims, 7 Drawing Sheets

MASSAGING SYSTEM AND METHOD

BACKGROUND

If a person wants a massage, she can either pay a masseuse some ridiculous hourly rate, or she can buy a "massaging" chair which provides a steady, predictable, annoying vibration at various spots on her back. Yet, the only people who consider nauseating vibrations a substitute for a sensuous massage are the marketers and manufacturers who build and sell these terrible devices.

SUMMARY OF THE INVENTION

The present invention aims to solve one or more of these and other problems.

According to a preferred embodiment, a massaging system comprises: an input device connectable to a massaging device that is responsive to an input signal obtained from the input device, the input device comprising a pressure-position profile sensor. The massaging system may further comprise the massaging device, the massaging device configured to massage at least a portion of a human body. The input signal may be mechanical, electronic, pneumatic, or hydraulic.

In one aspect, the massaging device may comprise: a plurality of contact portions configured to contact the portion; and a plurality of electric actuators connected to the contact portions, at least one actuator configured to cause at least one contact portion to contact the portion with at least one of a predetermined pressure and a predetermined force that depends on a current passing through the at least one actuator. In one aspect, the massaging device may comprise a current limiting device connected to the at least one actuator and configured to limit the at least one of a predetermined pressure and a predetermined force.

In one aspect, the massaging device may comprise: at least one contact hand configured to contact the portion, the contact hand comprising at least a first contact portion movable in a first arc and a second contact portion movable relative to the first contact portion in a second arc, the second arc angled with respect to the first arc by between approximately 45° and 135°.

In one aspect, the massaging device may comprise a plurality of contact portions configured to contact the portion, each of the contact portions movable in X, Y, and Z directions and rotatable about an axis.

In one aspect, the massaging device may comprise: a substantially continuous array of actuators configured to contact the portion via at least one contact portion, wherein the massaging device is configured to adjust each of the actuators in the array to provide a pressure-position massage profile on the portion that corresponds to the pressure-position profile sensed by the sensor.

In one aspect, the input device may be configured such that, when a human hand provides a manual input to the input device by touching the input device at an input location and with an input pressure that vary with time, the input device generates a timed signal representing a pressure-location profile of the manual input.

In one aspect, the massaging system may comprise: the massaging device, the massaging device configured to massage at least a portion of a human body; an information storage device configured to store the timed signal; and a processor connected to the information storage device and configured to provide instructions to the massaging device to massage the portion corresponding to the timed signal, wherein the processor is configured to be able to operate in at least two modes: a) to provide the instructions to the massage device synchronously with the timed signal; and b) to provide the instructions to the massage device nonsynchronously with the timed signal by storing and subsequently retrieving the timed signal in the information storage device. The processor may be configured to be able to operate in a repeat mode, whereby the processor provides the instructions to the massage device corresponding to the timed signal at least twice in succession.

In one aspect, the input device may have a torso shape corresponding to a human torso. In one aspect, the massaging system may comprise the massaging device, wherein the massaging device is configured to massage a human back and further comprises a perimeter sensor configured to sense a perimeter of the human back, wherein the massaging device is configured to associate the perimeter to the torso shape, whereby the input signal obtained from the input device is modified so that a location of a manual input applied to the input device is associated with a corresponding location on the human back.

In one aspect, the input device is configured such that, when fingers and a thumb of a human hand provide manual inputs to the input device by touching the input device at input locations and with input pressures that vary with time, the input device generates a timed signal representing pressure-location profiles of the manual inputs, and wherein the system further comprises: a massaging device connected to the input device, configured to massage at least a portion of a human body, and comprising at least one contact hand configured to contact the portion, the contact hand comprising at least one contact finger and at least one contact thumb movable with respect to the contact finger; and a processor connected between the massaging device and the input device and configured to generate a processor output based at least in part on the timed signal obtained from the input device, wherein the processor converts the timed signal into at least a first instruction to move the at least one contact finger and at least a second instruction to move the at least one contact thumb, whereby the at least one contact finger and the at least one contact thumb contact the portion with pressures and locations that correspond to the input pressures and the input locations.

In one aspect, the system may be configured so that the at least one contact finger and the at least one contact thumb contact the portion with pressures that correspond to and are substantially equal to or linearly scaled upward or downward to the input pressures.

The contact hand may comprise exactly one contact finger and exactly one contact thumb, wherein the processor determines from the timed signal a first pressure-location profile corresponding to at least one finger of the human hand, and a second pressure-location profile corresponding to the thumb of the human hand, and converts the first pressure-location profile to the first instruction, and the second pressure-location profile to the second instruction. The contact finger may have a larger cross sectional area than the contact thumb. The massaging device may comprise exactly two contact hands movable relative to each other.

According to another embodiment, a massaging system comprises: a massaging device configured to massage at least a portion of a human body and comprising: a first track running in a direction substantially parallel to a length of the portion; a second track running in a direction substantially perpendicular to the length of the portion; and at least one contact hand connected to the first and second tracks, configured to move in the parallel and perpendicular directions, and configured to contact an upper surface of the portion, wherein at least one of the first and second tracks is curved, whereby the contact hand is capable of contacting side surfaces of the portion. The at least one contact hand may comprise at least one contact finger and at least one contact thumb movable with respect to the contact finger. The massaging device may comprise exactly two contact hands movable relative to each other.

In one aspect, the contact hands are each configured to move in a direction substantially perpendicular to the parallel and perpendicular directions and to rotate about an axis.

In one aspect, each of the first and second tracks has a generally arc shape positioned so that ends of the tracks face generally downward.

In one aspect, the system further comprises an input device connected to the massaging device and comprising a pressure-position profile sensor, wherein the input device is configured such that, when a human hand provides a manual input to the input device by touching the input device at an input location and with an input pressure that vary with time, the input device generates a timed signal representing a pressure-location profile of the manual input, and wherein the massaging device is configured to move the at least one contact hand in accordance with the timed signal.

According to another embodiment, a massaging system comprises: a massaging device configured to massage at least a portion of a human body and comprising at least one contact hand configured to contact the portion, the at least one contact hand movable in X, Y, and Z directions and rotatable about an axis, the at least one contact hand comprising at least one contact finger and at least one contact thumb movable with respect to the contact finger. The massaging device may comprise exactly two contact hands movable relative to each other, and wherein each contact hand comprises exactly one contact finger and exactly one contact thumb.

In one aspect, the system may further comprise: an input device connected to the massaging device and comprising a pressure-position profile sensor, wherein the input device is configured such that, when fingers and a thumb of a human hand provide manual inputs to the input device by touching the input device at input locations and with input pressures that vary with time, the input device generates a timed signal representing pressure-location profiles of the manual inputs; and a processor connected to the input device and configured to generate a processor output based at least in part on the timed signal obtained from the input device, wherein the processor converts the timed signal into instructions to move the at least one contact hand, the at least one contact finger, and the at least one contact thumb, whereby the at least one contact finger and the at least one contact thumb contact the portion with pressures and locations that correspond to the input pressures and the input locations.

According to another embodiment, a method of massaging comprises: providing the massaging system as described; sensing a pressure-position input profile of a manual input to the input device; and applying a pressure-position massage profile to the portion based at least in part on the pressure-position input profile.

DETAILED DESCRIPTION

Figure 1:
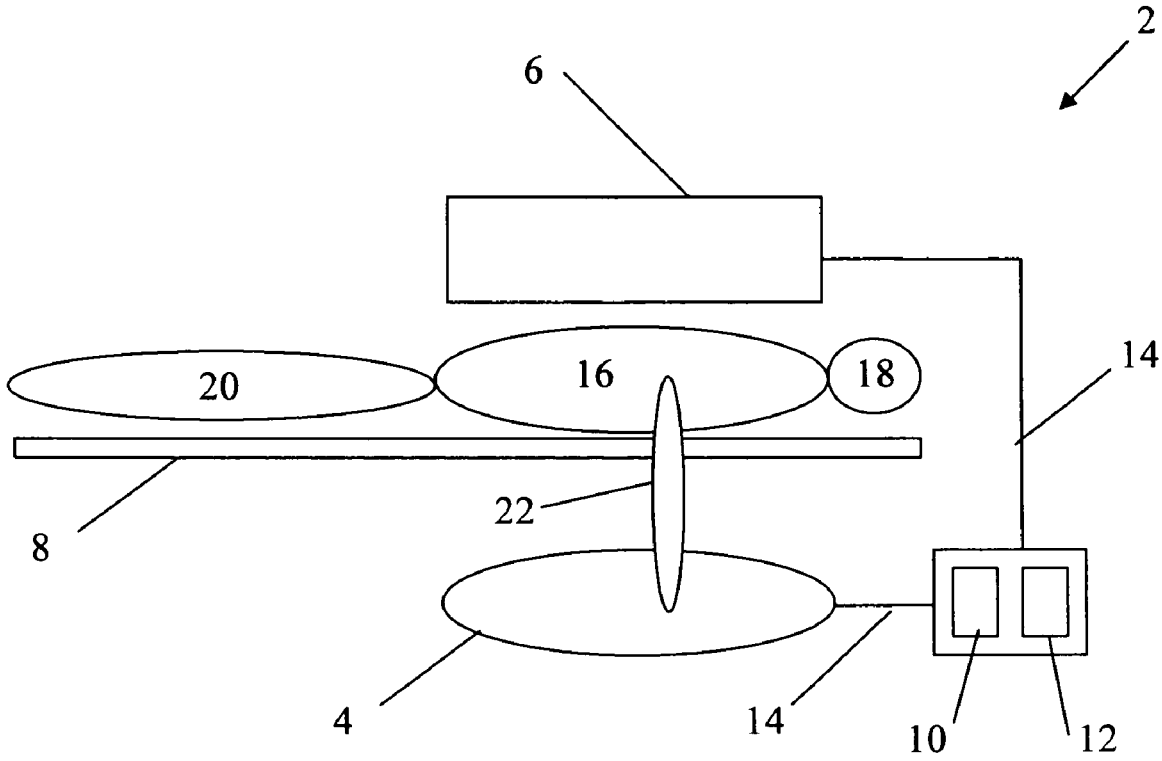
FIG. 1 is a side view of a massaging system according to an embodiment.

Referring now to FIG. 1, a massaging system 2 comprises an input device 4, a massaging device 6, a table 8, a processor 10, an information storage device 12, an electrical line 14 connecting the processor 10/storage 12 to the input device 4 and the massaging device 6, and a human body having a torso 16, a head 18, legs 20, and arms 22.

The table 8 is configured to support the human body, or at least a portion of it, preferably comfortably, and so it may include an appropriate shape and cushions. Comfortable recliners and tables are well known in the art of massaging, and will not be further described herein. The massaging device 6 is shown located above the table 8, specifically above the torso 16 or back region of the human body, so that it is configured to massage the human's back. Of course, the present invention is applicable to any portion of the body that may be massaged, particularly the head, arms, legs, and chest.

The input device 4 is preferably reachable by the human's arms 22, so that the human may provide a manual input to the input device 4 while lying face-down on the table 8. Thus, the human may provide a manual input to the input device 4 while remaining in the same position (face down) for receiving a massage by the massaging device 6. For example, the human may provide the input to the input device 4 substantially simultaneously to receiving a massage (preferably, but not necessarily, the corresponding massage) by the massaging device 6. For example, the system 2 may be configured so that a manual input provided to the input device 4 causes a timed signal to pass through the processor 10 (which may or may not alter the signal, such as to convert the signal to instructions understandable by the massaging device 6) to the massaging device 6 effectively instantaneously, so that the massaging device 6 provides a contact or touch or massage to the human body corresponding to (and at the same time as) the manual input provided to the input device 4—e.g., a "real-time" massage. Alternatively or in addition, the system 2 may be configured so that there is a delay (e.g., at least 1 second, at least 5, at least 10, or at least 20 seconds) from the time of manual input to the input device 4 to the time of execution of the corresponding instructions (as generated by the processor 10) by the massaging device 6—e.g., a "delay" massage.

Alternatively or in addition, the system 2 may be configured so that the human may provide the input to the input device 4 without receiving a massage by the massaging device 6, so that the manual input to the input device 4 is sent as a timed signal to the processor 10 and recorded in the storage 12. The information in the storage 12 may later (such as, but not necessarily, after the human has finished providing the manual input to the input device 4) be converted to instructions by processor 10 and sent to massaging device 6, which massages the appropriate portion (e.g., torso 16) based on the instructions. Thus, the human may provide a manual input of a desired massage to the input device 4, store it in the storage 12, and then come back later to execute the "stored" massage. Of course, processor 10 and storage 12 may be omitted if the timed signal generated by the input device 4 is readable by the massaging device 6.

The processor 10 may include an input apparatus to allow the human to provide instructions to the processor. For example, the human may want to request a "real-time" massage, a "delay" massage, a "stored" massage, etc., as described above. The human may also increase or decrease a pressure provided by the contact hands (described later) of the massager, or may want to heat the contact hands, or may want to turn the system on or off, etc. Any of the commands provided by the human (such as "input," "execute" "real-time," "delay two seconds," "heat 95 degrees," "increase pressure one level," "stop," "pause," etc.) may be provided to the processor 10 by any input apparatus known in the art of computers (not shown), such as but not limited to a mouse, stylus, keyboard, button, switch, touchpad, etc., or via a voice activation device.

Figure 2:
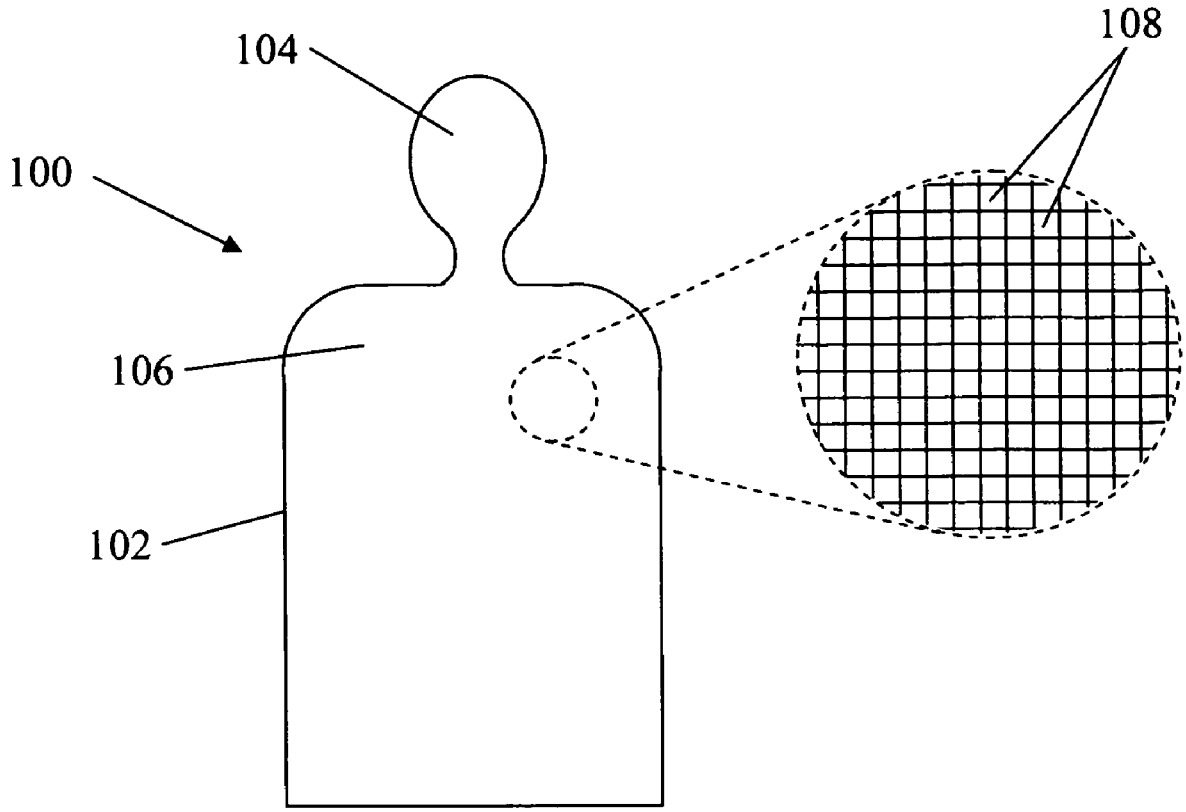
FIG. 2 shows a top view of an input device according to an embodiment, as well as an exploded view of the input device.

Referring now to FIG. 2, an input device 100 has a shape that preferably corresponds to a shape of the portion of the human body being massaged. For example, in the case shown in FIG. 1 in which the human's torso or back is being massaged, the input device 100 in FIG. 2 has a substantially torso shape 102, and the shape may include a head portion 104, if desired, or an arm portion (not shown), etc. The input device 100 is shaped and configured so that a human may manually input his desired massage (to be executed by the massaging device 6) by actually massaging the input device 100 in a corresponding manner. The input device 100 may comprise a material that emulates a compressibility and/or softness of the portion of the human body. As an example only, the input device 100 may comprise a rubber-type material, such as latex, or a compressible foam or sponge material, so that the input device 100 compresses and moves, upon a "massaging" manual input, in a manner similar to the compression and movement of a human back during a massage.

The input device 100 preferably has a pressure-location profile sensor 106, of which a portion is exploded for a better view. The pressure-location profile sensor 106 may include a plurality (e.g., an array) of very small pressure-sensitive sensors 108 that are connected in a predetermined fashion so that their location is known. Each pressure-sensitive sensor 108 may sense application of a pressure in one or more gradations, such as 16 or 32 or 64 or more gradations. Of course, if sensors 108 of profile sensor 106 each has only one pressure sensing gradation, then the profile sensor 106 is only a location profile sensor, as it cannot distinguish between varying levels of pressure, and can only determine locations of application of pressure. However, if at least one (but preferably all) of sensors 108 each has at least two (but preferably a larger number, preferably a power of 2, such as 128) gradations, then the profile sensor 106 is a pressure-location profile sensor, as it can detect both locations and varying degrees of pressure applied to the input device 100.

Of course, the level of location resolution of the pressure-location profile sensor 106 depends on the smallness (or density) of the pressure-sensitive sensors 108 in the profile sensor 106, and the level of pressure resolution of the pressure-location profile sensor 106 depends on the number of gradations measurable by each sensor 108. This analysis assumes that sensors 108 act as digital devices. However, as one of ordinary skill in the art will recognize, sensors 106 may be (and probably are) analog sensors whose outputs are turned into digital signals having the desired number of gradations by a digital processor, such as processor 10 in FIG. 1. In such a case, the level of pressure resolution of the pressure-location profile sensor 106 depends on the precision of the sensors 108—i.e., their ability to repeatably provide a particular output range given a predetermined pressure input. In one embodiment, the sensors 108 are distributed with a linear density of at least about 2 per inch, at least about 5 per inch, or at least about 10 per inch. Alternatively, the sensors 108 may be distributed with a linear density of at most about 2 per inch, at most about 5 per inch, or at most about 10 per inch.

Figure 3A:
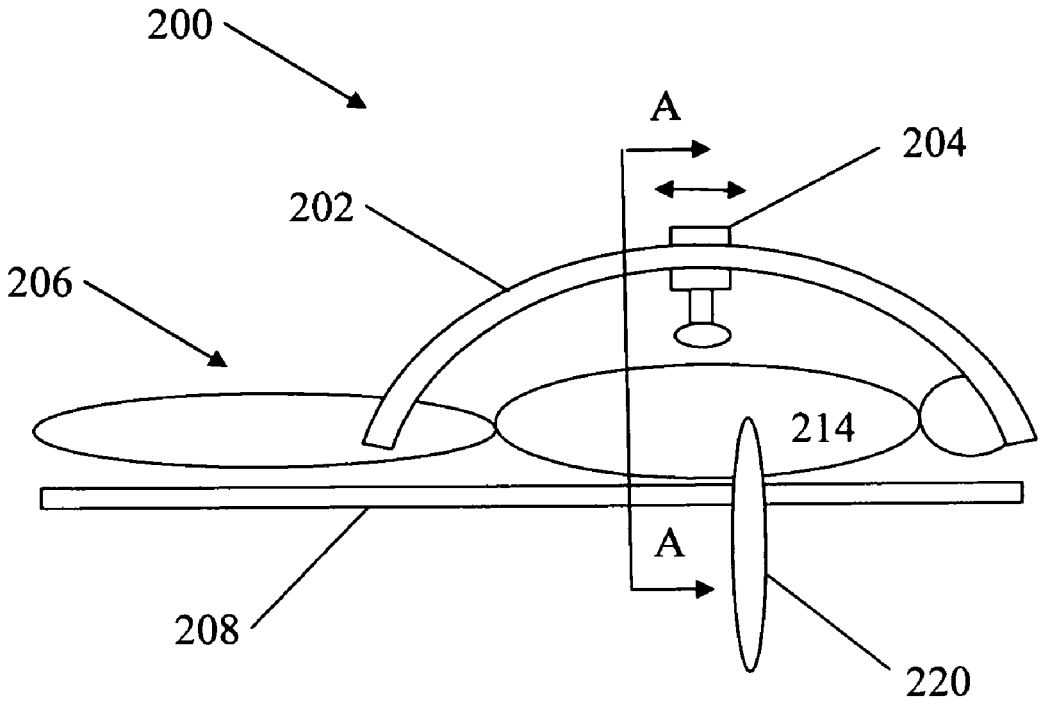
FIG. 3*a* shows a side view of a massaging device according to an embodiment.
Figure 3B:
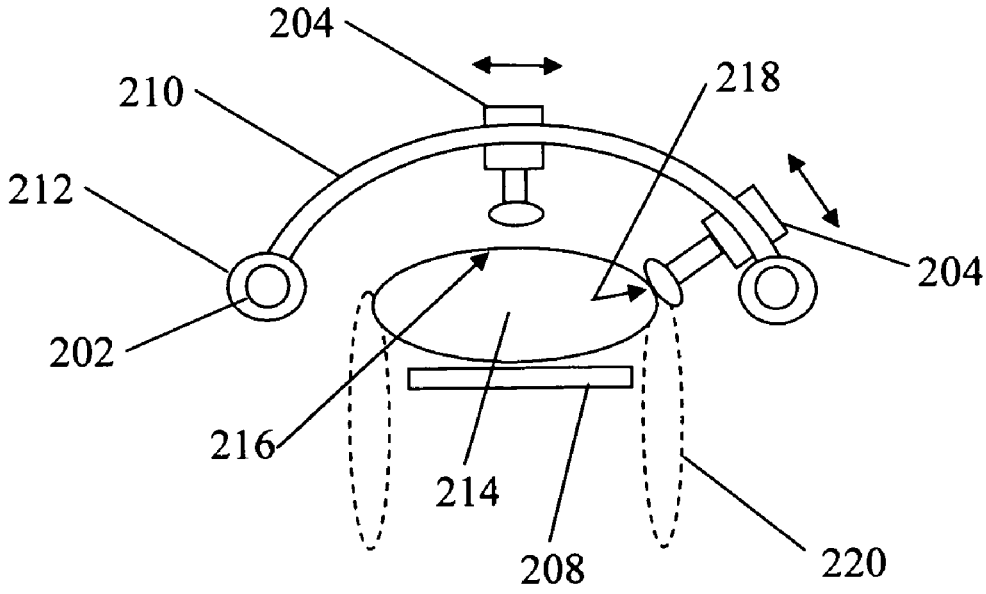
FIG. 3*b* shows a cross section through section A-A of the massaging device shown in FIG. 3*a*.

Referring now to FIGS. 3*a* and 3*b*, a massaging device 200 is located above a table 208 configured to support a human body 206 having a torso 214 and arms 220. The massaging device 200 comprises a preferably curved track 202 that runs in a direction substantially parallel to the length of the torso 214, and a preferably curved track 210 that runs in a direction substantially perpendicular to the length of the torso 214. Curved track 210 is connected and slidable along curved track 202, and comprises motors/movement devices 212 in contact with curved track 202 that powers movement of the curved track 210 along the curved track 202. Motor/movement devices are well known in the art, may comprise motors (e.g., electric, hydraulic, pneumatic, etc.), gears, wheels, friction surfaces, pulleys, belts, etc., and will not be further discussed here. Further, motors/movement devices 212 are controllable according to instructions received from the processor 10 (shown in FIG. 1), and may be powered by an external power supply (not shown).

The massaging device 200 also comprises at least one and preferably two contact hands 204 that are connected and slidable along curved track 210. Each contact hand 204 also comprises a motor/movement device in contact with the curved track 210 that powers movement of contact hand 204 along the curved track 210. Thus, each contact hand 204 is movable in an X-Y plane substantially parallel to a surface of the human's back. (Here, because the tracks 202, 210 are curved, which they need not be, hands 204 also move in a Z direction when moving along the tracks 202, 210.) Thus, contact hands 204 are movable in the directions shown by the arrows. Further, because the tracks 202, 210 are curved in a preferred embodiment, such that ends of the tracks point substantially downward, the contact hands 204 are capable of contacting (e.g., massaging) both a top surface 216 of the back, as well as side surfaces 218 of the back, as shown.

In the embodiment shown, because two contact hands 204 are attached to the same slidable curved track 210, their relative positions may change only along a direction of the track 210, but are stationary with respect to the direction of the track 202. This configuration emulates an actual, typical human massage, because a masseuse will often keep her hands relatively fixed in a direction parallel to the back, but may move her hands in a direction perpendicular to the back. (In other words, a masseuse will not often have one hand at an upper portion of the back, toward the head, and the other hand at a lower portion of the back.) In such a case, the processor 10 may be configured to convert the timed signal from the input device 4 to a modified instruction to the massaging device 200 that takes into account that the contact hands 204 are not relatively movable in a direction parallel to the length of the torso 214. For example, if the timed signal indicates a manual input on an "upper" portion (i.e., near the head portion 104 of input device 100) and another manual input on a "lower" portion, the processor 10 may average these locations on the axis parallel to the length of the torso 214, so that the instructions sent to the massaging device 200 provide a pressure-location massage profile in which both contact hands 204 are relatively stationary in the direction parallel to the length of the torso 214.

Nevertheless, an embodiment in which the contact hands 204 are movable with respect to each other in both directions (i.e., parallel and perpendicular to the length of the back) in response to instructions received from the input device 4 or processor 10 (shown in FIG. 1) are within the scope of the present invention. Such a mechanical configuration will be understood by one of ordinary skill in the art, and further details will be omitted. Each contact hand 204 comprises a contact portion or contact finger (described later) that is movable in a direction substantially perpendicular to the tracks 202, 210, so that the contact portion can contact and provide an appropriate pressure and/or force to the human's torso 214. For example, in FIG. 3*b*, the left-hand contact hand 204 is located above but does not contact the top surface 216 of the torso 214, while the right-hand contact hand 204 is located adjacent to and in contact with the side surface 218 of the torso 214. The force or pressure provided by the contact portion may be adjusted by the contact hand 204 in response to instructions received from the input device 4 or processor 10 (shown in FIG. 1).

Figure 5A:
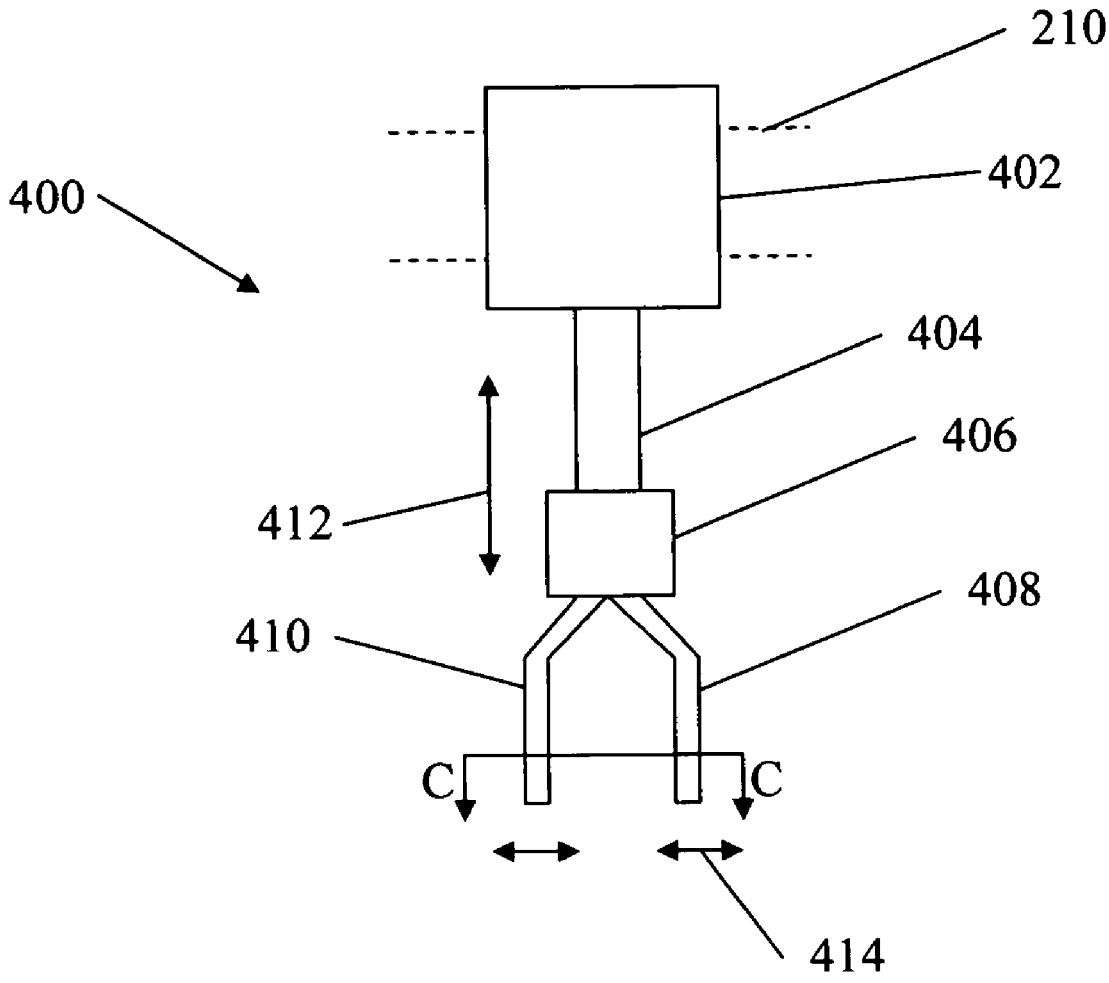
FIG. 5*a* shows a contact hand according to an embodiment.
Figure 5B:
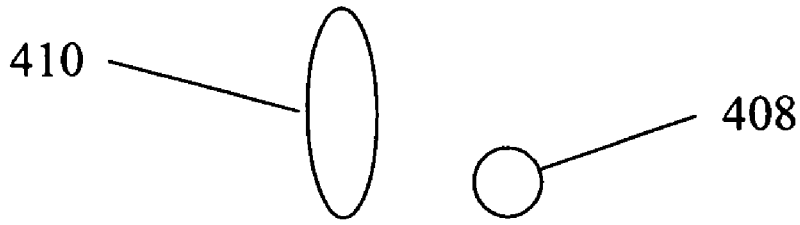
FIG. 5*b* shows a cross section through section C-C of the contact hand shown in FIG. 5*a*.

Referring now to FIGS. 5*a* and 5*b*, each contact hand 400 (which may be contact hand 204 shown in FIGS. 3*a* and 3*b*) includes a motor/movement device 402 configured to move along a track, such as curved track 210 shown in FIG. 3*b*. The contact hand 400 also includes a preferably linear actuator 404, a clamping mechanism 406, and preferably two contact portions: a contact finger 410 and a contact thumb 408. Actuator 404 is configured to move the clamping mechanism 406 in a direction substantially perpendicular to a movement of the contact hand 400 along the curved track 210 and to a movement of the curved track 210 along the curved track 202 (not shown in FIG. 5*a*). In other words, the actuator 404 is configured to move the clamping mechanism 406 and contact finger/thumb 410/408 toward and away from the portion of the human body being massaged, as shown by arrow 412. The actuator 404 may be any device that provides motion, preferably one-dimensional or one-directional (e.g., arc) motion, such as an electric/magnetic, hydraulic, or pneumatic actuator.

Clamping device 406 is connected to and configured to move the contact finger 410 and contact thumb 408 relative to each other in direction shown by arrows 414, so that the contact finger/thumb 410/408 can close and open relative to each other to provide a corresponding gripping and releasing sensation on the human's back (or massaged portion). Clamping device 406 could be, e.g., a linear actuator connected to mechanical levers such that movement of the actuator causes an open and closing action of the contact finger/thumb 410/408. Clamping devices are well known in the art, and further detail will be omitted.

As shown in FIG. 5*b*, contact finger 410 preferably has a larger cross section than contact thumb 408, and may have a cross section that corresponds to a cross section of all four fingers of a human hand grouped together, while contact thumb 408 may have a cross section that corresponds to that of a human thumb. Further, tips of the contact portions 408, 410 may be relatively soft, and may have a compressibility or softness similar to that of corresponding human fingers/thumbs. For example, they may be coated with a rubber or foam-type material to provide a padded, soft feel. Further, contact finger 410 may comprise at least two portions (not shown) that are moveable with respect to each other, up to four portions, to correspond to four fingers.

Reference number 404 may refer alternatively or in addition to a rotation device, and "contact hand" may refer to the combination of the clamping mechanism 406 with the contact portions 408, 410, such that the contact hand is rotatable about an axis (e.g., an axis parallel to the direction indicated by arrow 412). In such an embodiment, not only are contact portions 408, 410 movable relative to each other in a gripping/ungripping manner by the clamping mechanism 406, but they are also rotatable about a center axis so that their angular orientation (relative to the human body) can change. Alternatively, the clamping device 406 may comprise the rotation device and the contact hand may comprise the contact portions 408, 410. Rotation devices that rotate one object relative to another based on an input command or instruction are, again, well known in the art, and further detail will be omitted. An advantage to such an embodiment is that most hand movement during a massage by a masseuse includes a gripping/ungripping motion of the hand coupled with a rotation of the wrists, both of which may be accomplished by each contact hand 400. Further motion is typically performed by movement of the arms, which corresponds in the present invention to motion of the contact hands 400 along the corresponding curved tracks 202, 210.

In operation of the massaging device 200 (shown in FIGS. 3*a* and 3*b*) using the contact hands 400 (shown in FIGS. 5*a* and 5*b*), the massaging device 200 receives instructions from the input device 4 or processor 10 to move the contact hand(s) 204 along tracks 202, 210 to the appropriate location(s), so that the contact portions 408, 410 of the contact hands 400 will, when actuated, contact the torso 214 in the locations commanded by the input device 4 or processor 10. Then, the contacts hands 400 are actuated such that they move toward and contact the human's torso 214, and the force and/or pressure of contact against the torso 214 is adjusted by the actuator (such as adjusting the current in an electric actuator, adjusting the air pressure in a pneumatic actuator, etc.). The locations and pressure imparted to the torso 214 (in the form of a pressure-location massage profile) depend on and preferably correspond to a pressure-location input profile as sensed by the input device 4 (and possibly converted by the processor 10).

Figure 4A:
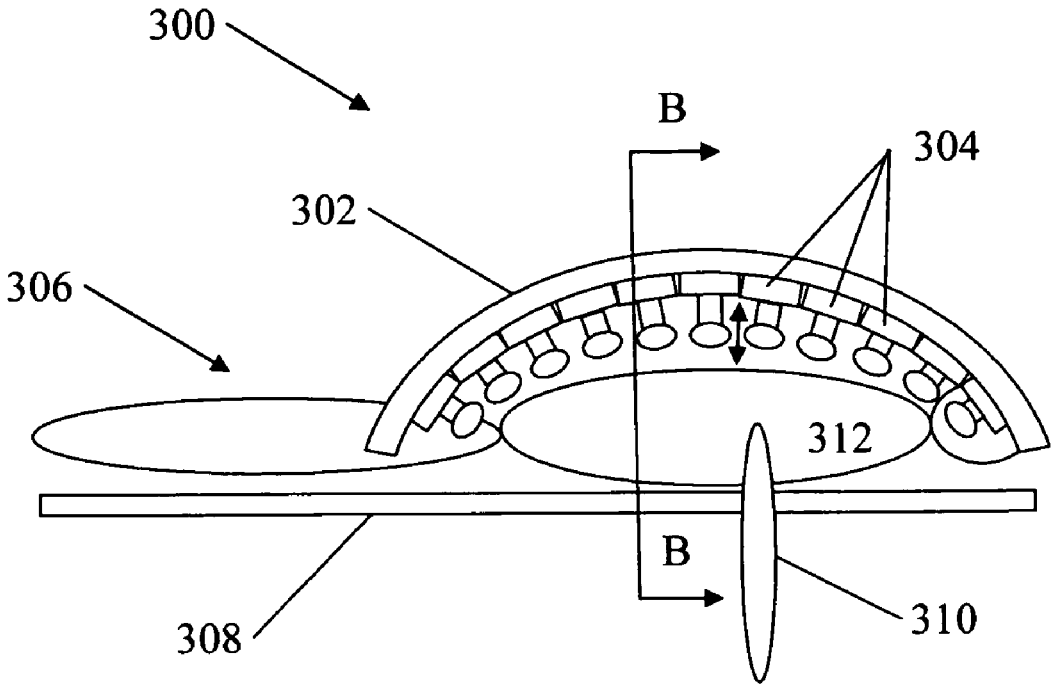
FIG. 4*a* shows a side view of another massaging device according to an embodiment.
Figure 4B:
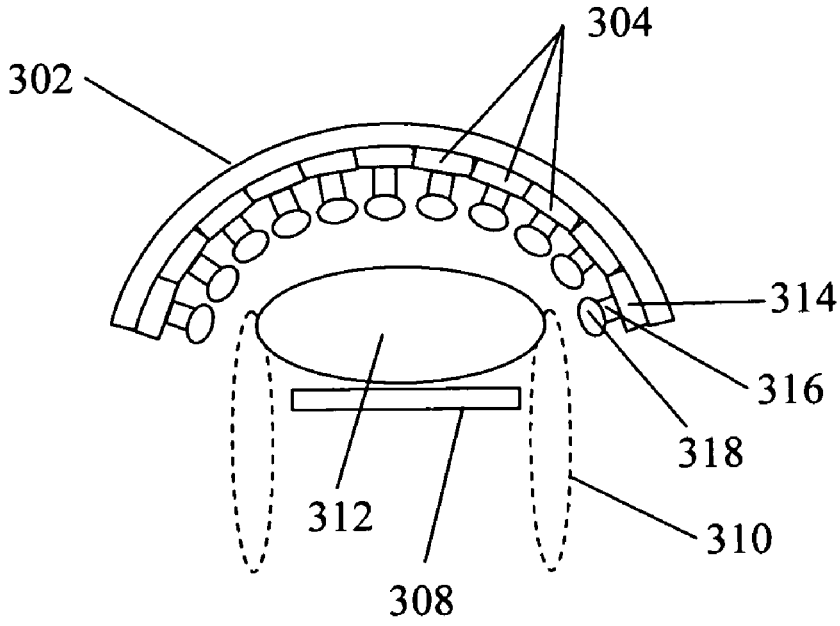
FIG. 4*b* shows a cross section through section B-B of the massaging device shown in FIG. 4*a*.

Referring now to FIGS. 4*a* and 4*b*, another embodiment of a massaging device 300 comprises an array 302 of contact hands 304 that are closely space apart. The massaging device 300 is located substantially above a table 308 supporting a human body 306 having a torso 312 and arms 310. The contact hands 304 are preferably fixed to the array 302, and each comprises a base portion 314, a preferably linear actuator 316, and a contact portion 318. Each contact hand 304 may be actuated substantially independently of the others based on an instruction or command from either the input device 4 or processor 10 (shown in FIG. 1), and each actuator 316 is configured to cause the contact portion 318 to move in a direction substantially perpendicular to the array 302 (as shown by the arrow), thus toward and away from the portion (in this case, the torso 312) being massaged. The contact portion 318 may comprise a soft, compressible material to provide a comfort to the human, or alternatively or in addition a sheet of a soft, compressible material (not shown) may cover the contact portions 318 as a continuous sheet. The array 302 is preferably curved as shown, so that sides of the torso may be contacted and massaged by contact hands 304 near the ends/edges of the array 302.

In operation, after a human lies face down on the table 308 and begins a massaging program or routine, the contact portions 318 of the contact hands 304 are moved via actuators 316 toward the human's torso 312 (or other massaged portion) until they gently rest against it. Then, the array 302 provides a pressure-location massage profile corresponding to the pressure-location input profile by independently actuating the appropriate contact hands 304. One of ordinary skill in the art will understand how the pressure-location massage profile can be imparted on the torso 312 by substantially independently adjusting the force and/or pressure provided by each contact hand 304. Of course, the contact hands 304 may include gripping or clamping elements as shown in FIGS. 5*a* and 6.

Figure 6:
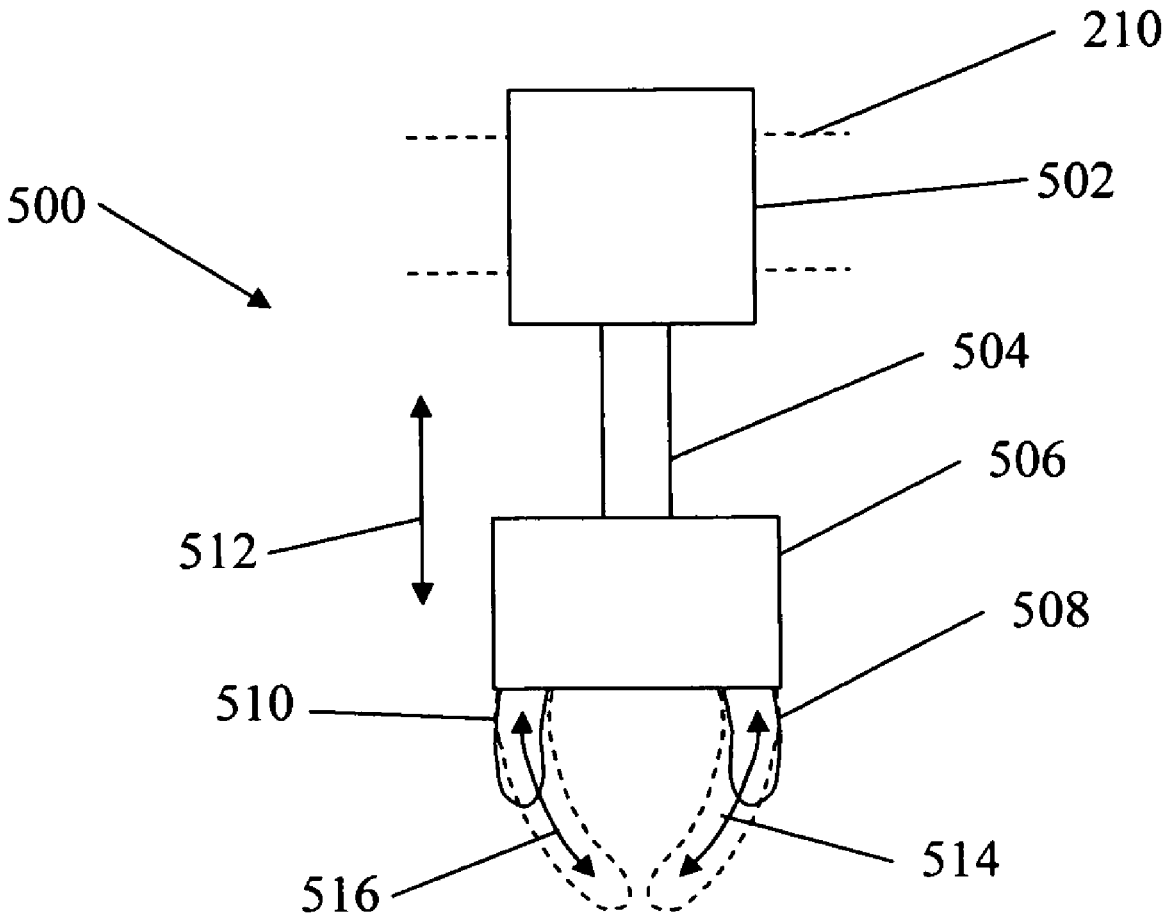
FIG. 6 shows another contact hand according to an embodiment.

Referring now to FIG. 6, another embodiment of a contact hand 500 (such as could be applied as the contact hand 204 in FIGS. 3*a* and 3*b*) comprises a motor/movement device 502 connected to and configured to move along track 210 (shown in FIG. 3*b*), an actuator and/or rotating device 504, a clamping mechanism 506 movable by the actuator 504 in the direction indicated by arrow 512, and a contact finger 510 and a contact thumb 508 movable along arcs 516, 514, respectively. Clamping device 506 may comprise actuators (e.g., electric, pneumatic, etc.) that move the contact portions 508, 510 along the respective arcs 514, 516, so that the contact portions 508, 510 move substantially only along the arcs 514, 516. The arcs 514, 516 may be angled with respect to each other (anywhere along the arcs) at between approximately 45° and 135°, preferably between approximately 60° and 120°, and preferably around 90°, so that bottom tips of the contact portions 508, 510 are pointed substantially toward the portion of the human body being massaged when the contact hand 500 is in a non-gripping position, and are pointed substantially toward each other when the contact hand 500 is in a gripping position. This configuration substantially emulates the movement of the fingers and thumb of a human hand when it is massaging a portion of a human body. As with the embodiment shown in FIGS. 5*a* and 5*b*, the contact portions 508, 510 may rotate about an axis, and may have cross sections as shown in FIG. 5*b*.

Figure 7:
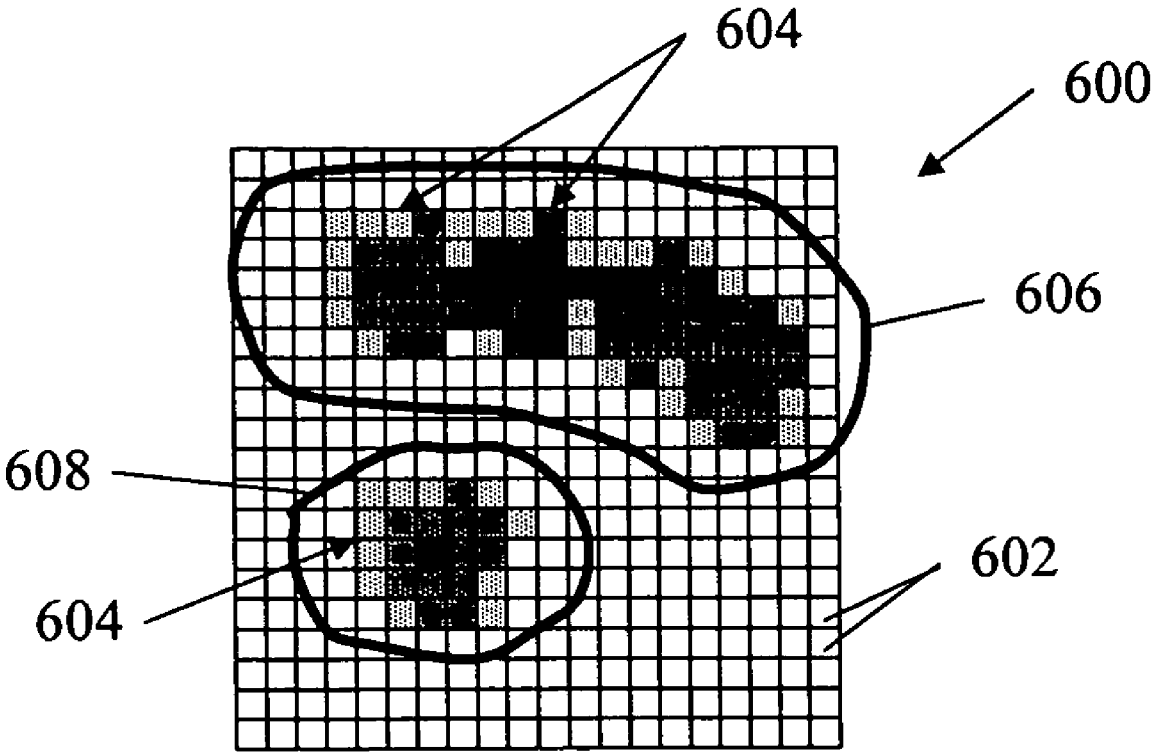
FIG. 7 shows a pressure-location profile of a manual input that is input into the input device.

Referring now to FIG. 7, an exemplary portion of a pressure-location input profile 600 is shown. The input profile 600 shows various "pressure pixels" 602 representing the timed output from the input device (e.g., 4 in FIG. 1), where a white color represents no pressure and darker colors represent various gradations of pressure application. For example, the input profile 600 shows what appear to be finger/thumb inputs 604 by four fingers and a thumb. Notice that the pressure is highest near the center of each input 604 and drops off substantially radially outwardly.

In the embodiment in which the contact hand comprises fewer than four contact fingers and one contact thumb (e.g., FIG. 5*b*), the processor 10 (FIG. 1) may be configured to convert a manual input having five finger/thumb inputs 604 into an instruction to move the fewer number of contact portions in the massaging device. For example, in the example of FIG. 5*b* in which each contact hand 400 has one contact finger 410 and one contact thumb 408, the processor 10 may be configured to group the four finger inputs 604 into one finger input 606, and the thumb input 604 into one thumb input 608, and the instructions to the contact hand 400 from the processor 10 may reflect this grouping by providing one instruction to the contact finger 410 corresponding to the one finger input 606, and one instruction to the contact thumb 408 corresponding to the one thumb input 608. The processor 10 may analyze and process the input profile 600 to group the four finger inputs 604 into the one finger input 606 (and to differentiate the thumb input 608 from the one finger input 606) by any means currently known in the art. For example, the processor 10 may implement an intelligent software stored in the storage 12 that is able to differentiate finger inputs from thumb inputs based on any of: proximity (fingers are often closer to each other than to thumb), pressure (the thumb, because of its strength, often provides more pressure than fingers), location (the thumb is usually located "below" (i.e., further from the human's head than) the fingers, or to the side, such as to the left on the right hand, etc.), etc., or a combination of any of these. One of ordinary skill in the art will understand how to draft software to differentiate finger inputs from thumb inputs based on any of these criteria. Further, the software may implement "thumb tracking," in which, once the thumb is identified (such as by proximity sensing), the processor 10 "follows" the thumb by noticing in each subsequent time frame where the nearest and darkest (i.e., highest pressure) input is located to the thumb input previously measured, and then associating this new dark input with the thumb input. Point tracking is further described in U.S. patent application No. ??? entitled "A Method For Increasing Resolution in a Camera," filed Mar. 22, 2004, which is herein incorporated by reference.

The processor 10 is preferably configured to receive a timed signal of a pressure-location input profile (or only a location profile) from the input device 4 and convert the timed signal into instructions (e.g., a corresponding pressure-location massage profile) for the massaging device 6 which may be first stored in the storage 12 or fed immediately to the massaging device 6. The processor 10 may adjust the locations of the pressure-location massage profile based on a difference in size between the input device 4 and the portion of the human body being massaged. For example, if the human portion is much larger than the input device 4, then a location massaged on the input device 4 will not necessarily correspond to the location actually massaged by the massaging device 2, unless the processor 10 (preferably linearly) scales the instructions according to the scale in size between the input device 4 and the human portion.

Thus, either of the massaging devices 200 or 300 may also serve as a perimeter sensor configured to sense a perimeter of the human portion, and the massaging device 200, 300 may be configured to associate this perimeter to the shape of the input device 4, so that the pressure-location input profile of the input to the input device 4 is modified so that a location of a manual input applied to the input device 4 is associated with a corresponding location on the human portion. In other words, the processor 10 may scale the instructions for the pressure-location massage profile up or down compared to the pressure-location input profile depending on a sensed size and/or perimeter of the human portion. Contact hands 204, 304 of massaging devices 200, 300 may be easily used as perimeter sensors by simply moving toward the human portion with a slow speed and little force, until the contact hands 204, 304 experience resistance (e.g., electrical resistance in the case of electric actuators 404, 316, etc.), at which point the processor 10 determines that an edge of the human portion has been reached. By repeating this process for a large number of locations on the human portion, a 3-D profile of the human portion may be compiled and formed by the processor 10 and stored in the storage 12. This process need only be performed for each human once. Thus, if three people share the massaging system, each person may simply input his name (or other identification) via the input device (e.g., a keyboard or voice activation), causing the processor 10 to find the 3-D profile of that person's portion in the storage 12. Then, when the person provides an input to the input device 4, the pressure-location massage profile is scaled accordingly so that, for example, when the person massages the left shoulder of the input device 4, the massaging device 6 accurately and correctly massages his left shoulder, and so forth.

Alternatively or in addition to the processor 10 scaling the locations of the pressure-location massage profile in accordance with a difference in size between the input device 4 and the human portion, the processor 10 may be configured to (preferably, although not necessarily, linearly) scale the pressures of the pressure-location massage profile. In such an embodiment, the processor 10 may be programmed to provide a pressure-location massage profile having higher or lower absolute pressure magnitudes than the corresponding pressure-location input profile. This feature may allow the human to massage the input device 4 with far less force and effort than would ordinarily be necessary to obtain a corresponding massage.

The processor 10 may also implement a repeat mode such that the instructions or signal stored in the storage 12 may be provided to the massaging device 6 repeatably in succession, so that immediately or soon after the ending of a set of instructions, the processor 10 re-starts those instructions. The process may repeat indefinitely until the human turns the system 2 off, or otherwise provides a stop command.

To minimize the concern that the actuators accidentally or in a malfunction cause an excessive force or pressure on the human portion, the massaging system 2 may include a limiter configured to limit a total force and/or pressure applied to the human portion. For example, in the case of electric actuators 404 (FIG. 5*a*), the contact hand 400 may further include a current limiter (not shown), such as a fuse, a circuit breaker, or the like, to limit current (and, thus, the resulting force or pressure) imparted by the contact hand 400 to the human portion.

While depicted in the drawings as an electronic system, the massaging system 2 may be a mechanical device instead. For example, as a mechanical variation on the embodiment shown in FIGS. 4*a* and 4*b*, instead of an electronic pressure-location profile sensor being electronically connected to electric actuator array 302, the pressure-location profile sensor and array 302 may comprise a plurality of mechanical connections and levers (not shown), such that each sensor is the end of one lever, the other end of which is attached to a contact portion or hand. Hundreds of such levers move independently of each other, such that pressing down on the input device with a pressure-location input profile causes several levers to rotate downward, causing corresponding upper ends of the levers (those ends connected to the contact portions) to also move downward and provide a corresponding pressure-location massage profile to the massaged portion of the human back. In this embodiment, the levers may move with a single degree of freedom (rotation about a single axis), so that each contact portion remains substantially stationary in an X-Y plane parallel to a back of the human. In such an embodiment, the lower ends of the levers remain within the scope of a pressure-location profile sensor, because such a sensor still provides "instructions" (albeit through a mechanical connection) to the contact portions to provide a corresponding pressure-location massage profile. Of course, the input device could have a shape of the portion being massaged, such as a torso, and the lower tips of the levers (corresponding to the pressure-location profile sensor) may be inside the input device, so that the human may "massage" the input device to simultaneously be massaged by the massaging device.

Further, as a mechanical variation on the embodiment shown in FIGS. 3*a* and 3*b*, instead of an electronic pressure-location profile sensor being electronically connected to electric motor and actuator driven contact hand 204, the pressure-location profile sensor and contact hands may comprise a plurality of mechanical connections and levers, as in the above described embodiment, except with far fewer levers, and where each lever is moveable with more than one degree of freedom. For example, the pressure-location profile sensor may comprise two gloves, each glove having at least one (but preferably two, and most preferably five) independently moving lever, with one contact portion for each lever. The mechanical device is configured such that the two ends of each lever (one end connected to the glove and the other end connected to a contact portion) move in substantially the same way, while remaining separated by a preferably predetermined vector. Thus, the contact portions move (and thus effectively act) in the same manner as the gloves, which of course move with the human's manual input. In such an embodiment, the lower ends of the levers remain within the scope of a pressure-location profile sensor, because such a sensor still provides "instructions" (albeit through a mechanical connection) to the contact portions to provide a corresponding pressure-location massage profile. In such a case, the input device may comprise only such gloves, as the interaction of the contact portions of the levers with the portion of the human body being massaged may provide sufficient resistance that the gloves do not need to contact anything else. In other words, in this system, a human will lie face down on the table, put his hands in the gloves, and push down on the gloves until the contact portions contact his back (or whatever portion of his body). Then, by moving his fingers and/or gloves, the contact portions provide a corresponding pressure-location massage profile on his back.

Other embodiments are within the scope of the present invention. For example, the contact portions of any of the embodiments shown may further comprise heating elements, such as electric resistance elements, to provide a heating sensation to the human portion being massaged.

I claim:

1. A massaging system, comprising:

an input device connectable to a massaging device that is responsive to an input signal obtained from the input device, the input device comprising a pressure-position profile sensor; and further comprising a massaging device, configured to massage at least a portion of a human body, wherein the massaging device comprises:

a plurality of contact portions configured to contact said portion; and a plurality of electric actuators connected to said contact portions, at least one actuator configured to cause at least one contact portion to contact said portion with at least one of a predetermined pressure and a predetermined force that depends on a current passing through said at least one actuator.

2. The massaging system as claimed in claim 1, wherein the input device is configured such that, when a human hand provides a manual input to the input device by touching the input device at an input location and with an input pressure that vary with time, the input device generates a timed signal representing a pressure-location profile of the manual input, and wherein the system further comprises:

an information storage device configured to store said timed signal; and a processor connected to the information storage device and configured to provide instructions to said massaging device to massage said portion corresponding to said timed signal, wherein the processor is configured to be able to operate in at least two modes: a) to provide said instructions to said massage device synchronously with said timed signal; and b) to provide said instructions to said massage device nonsynchronously with said timed signal by storing and subsequently retrieving said timed signal in said information storage device.

3. The massaging system as claimed in claim 2, wherein the processor is configured to be able to operate in a repeat mode, whereby said processor provides said instructions to said massage device corresponding to said timed signal at least twice in succession.

4. The massaging system as claimed in claim 1, wherein the input device has a torso shape substantially corresponding to a human torso.

5. The massaging system as claimed in claim 4, wherein the massaging device further comprises a perimeter sensor configured to sense a perimeter of said human back, and wherein the massaging device is configured to associate said perimeter to said torso shape, whereby the input signal obtained from the input device is modified so that a location of a manual input applied to the input device is associated with a corresponding location on said human back.

6. The massaging system as claimed in claim 1, wherein the input device is configured such that, when fingers and a thumb of a human hand provide manual inputs to the input device by touching the input device at input locations and with input pressures that vary with time, the input device generates a timed signal representing pressure-location profiles of the manual inputs, wherein the massaging device comprises at least one contact hand configured to contact said portion, said contact hand comprising at least one contact finger and at least one contact thumb movable with respect to said contact finger, wherein the system further comprises a processor connected between the massaging device and the input device and configured to generate a processor output based at least in part on said timed signal obtained from the input device, and wherein the processor converts said timed signal into at least a first instruction to move said at least one contact finger and at least a second instruction to move said at least one contact thumb, whereby said at least one contact finger and said at least one contact thumb contact said portion with pressures and locations that correspond to said input pressures and said input locations.

7. The massaging system as claimed in claim 6, wherein the system is configured so that said at least one contact finger and said at least one contact thumb contact said portion with pressures that correspond to and are linearly scaled upward to said input pressures.

8. The massaging system as claimed in claim 6, wherein said contact hand comprises exactly one contact finger and exactly one contact thumb, wherein said processor determines from said timed signal a first pressure-location profile corresponding to at least one finger of said human hand, and a second pressure-location profile corresponding to said thumb of said human hand, and converts said first pressure-location profile to said first instruction, and said second pressure-location profile to said second instruction.

9. The massaging system as claimed in claim 6, wherein said contact finger has a larger cross sectional area than said contact thumb.

10. The massaging system as claimed in claim 6, wherein said massaging device comprises exactly two contact hands movable relative to each other.

11. A method of massaging, comprising:

providing the massaging system as claimed in claim 1;

sensing a pressure-position input profile of a manual input to said input device; and applying a pressure-position massage profile to said portion based at least in part on said pressure-position input profile.

12. A massaging system, comprising:

an input device connectable to a massaging device that is responsive to an input signal obtained from the input device, the input device comprising a pressure-position profile sensor; and further comprising a massaging device, configured to massage at least a portion of a human body, wherein the massaging device comprises a substantially continuous array of actuators configured to contact said portion via at least one contact portion, and wherein the massaging device is configured to adjust each of said actuators in said array to provide a pressure-position massage profile on said portion that corresponds to said pressure-position profile sensed by said sensor.

13. The massaging system as claimed in claim 12, wherein the input device is configured such that, when a human hand provides a manual input to the input device by touching the input device at an input location and with an input pressure that vary with time, the input device generates a timed signal representing a pressure-location profile of the manual input, and wherein the system further comprises:

an information storage device configured to store said timed signal; and a processor connected to the information storage device and configured to provide instructions to said massaging device to massage said portion corresponding to said timed signal, wherein the processor is configured to be able to operate in at least two modes: a) to provide said instructions to said massage device synchronously with said timed signal; and b) to provide said instructions to said massage device nonsynchronously with said timed signal by storing and subsequently retrieving said timed signal in said information storage device.

14. The massaging system as claimed in claim 13, wherein the processor is configured to be able to operate in a repeat mode, whereby said processor provides said instructions to said massage device corresponding to said timed signal at least twice in succession.

15. The massaging system as claimed in claim 12, wherein the input device has a torso shape substantially corresponding to a human torso.

16. The massaging system as claimed in claim 15, wherein the massaging device further comprises a perimeter sensor configured to sense a perimeter of said human back, and wherein the massaging device is configured to associate said perimeter to said torso shape, whereby the input signal obtained from the input device is modified so that a location of a manual input applied to the input device is associated with a corresponding location on said human back.

17. A method of massaging, comprising:

providing the massaging system as claimed in claim 12;

sensing a pressure-position input profile of a manual input to said input device; and applying a pressure-position massage profile to said portion based at least in part on said pressure-position input profile.

* * * * *